United States Patent [19]

Veneruso

[11] Patent Number: 4,806,928

[45] Date of Patent: Feb. 21, 1989

[54] APPARATUS FOR ELECTROMAGNETICALLY COUPLING POWER AND DATA SIGNALS BETWEEN WELL BORE APPARATUS AND THE SURFACE

[75] Inventor: Anthony F. Veneruso, Richmond, Tex.

[73] Assignee: Schlumberger Technology Corporation, Houston, Tex.

[21] Appl. No.: 74,445

[22] Filed: Jul. 16, 1987

[51] Int. Cl.[4] ..... G01V 1/00

[52] U.S. Cl. ..... 340/856; 340/857; 175/40; 336/DIG. 2

[58] Field of Search ..... 340/853, 856, 857; 336/DIG. 2; 175/40, 50; 166/66

[56] References Cited

U.S. PATENT DOCUMENTS

| | | | |
|---|---|---|---|
| 2,370,818 | 3/1945 | Silverman . | |
| 3,209,323 | 9/1965 | Grossman | 340/856 |
| 3,550,682 | 12/1970 | Fowler | 336/DIG. 2 |
| 3,949,032 | 4/1976 | Hossenlopp | 264/61 |
| 3,967,201 | 6/1976 | Rorden . | |
| 4,161,782 | 7/1979 | McCracken . | |
| 4,541,481 | 9/1985 | Lancaster . | |
| 4,544,035 | 10/1985 | Voss . | |
| 4,630,243 | 12/1986 | MacLeod . | |
| 4,648,471 | 3/1987 | Bordon | 166/55.1 |

*Primary Examiner*—Deborah L. Kyle
*Assistant Examiner*—John W. Eldred
*Attorney, Agent, or Firm*—Henry N. Garrana; John H. Bouchard

[57] ABSTRACT

In the representative embodiment of the new and improved apparatus disclosed herein, a downhole tool adapted to be coupled in a pipe string and positioned in a well bore is provided with one or more electrical devices cooperatively arranged to receive power from surface power sources or to transmit and/or receive control or data signals from surface equipment. Unique inner and outer coil assemblies arranged on ferrite cores are arranged on the downhole tool and a suspension cable for electromagnetically coupling the electrical devices to the surface equipment so that power and/or data or control signals can be transmitted between the downhole and surface equipment.

44 Claims, 3 Drawing Sheets

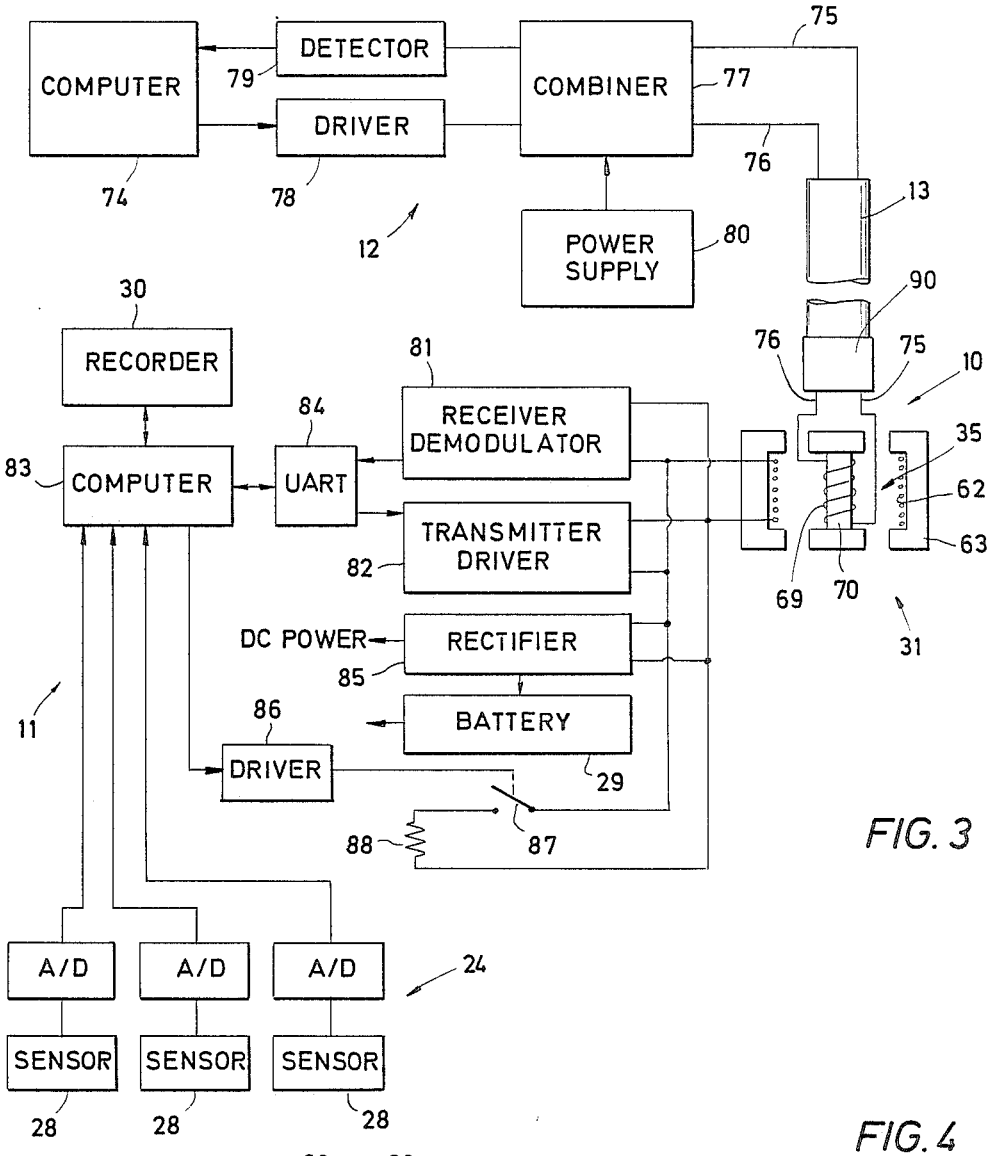
FIG. 3
FIG. 4
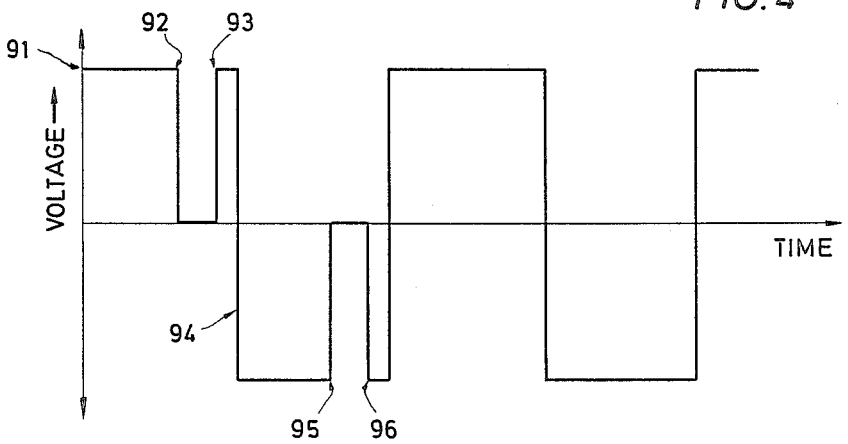

APPARATUS FOR ELECTROMAGNETICALLY COUPLING POWER AND DATA SIGNALS BETWEEN WELL BORE APPARATUS AND THE SURFACE

BACKGROUND OF THE INVENTION

Various systems have been proposed heretofore for transmitting data and/or control signals as well as electrical power over one or more electrical conductors interconnecting the surface equipment and sub-surface apparatus such as perforating guns, various downhole measuring devices, or controls for subsea well heads. Those skilled in the art will appreciate, however, that when the sub-surface apparatus is located in a pipe string it is difficult to provide a continuous trouble-free electrical communication path between the sub-surface apparatus and surface equipment. The simplest technique is, of course, to dependently couple the sub-surface apparatus to an electrical cable and then temporarily remove the apparatus and its supporting cable from the pipe string each time that a pipe joint is to be removed or added to the pipe string. This straight-forward technique is particularly useful for stationing a measuring instrument in a tubing string in a completed well bore and thereafter obtaining measurements as desired. Nevertheless, when this technique is used to make various measurements during the course of a typical drilling operation, there will be a significant increase in the amount of time required to carry out even the simplest downhole measurement. An example of this time-consuming technique is seen in U.S. Pat. No. 3,789,936.

Accordingly, to minimize the number of times that a measuring device has to be removed from the drill string during a drilling operation, as shown, for example, in U.S. Pat. No. 3,825,078, it has been proposed to support measuring instruments by an electrical cable that has an upper portion of considerable excess length that is arranged in one or more doubled loops in the upper portion of the drill string. A similar arrangement is seen in U.S. Pat. No. 4,416,494 where the extra portion of the cable is instead coiled within a special container disposed in the drill string. In either case, by arranging an electrical connector on the upper end of the cable, the upper end portion of the cable can be quickly disconnected from the surface equipment. In this manner, the upper end portion of the cable can be readily passed through a pipe joint that is either being removed from or added to the upper end of the drill string. The cable is then reconnected to the surface equipment and the drilling operation is again resumed. Additional sections of cable are periodically added to the upper portion of the cable to increase the overall length of the cable as the drilling operation continues to deepen the borehole. Despite the time-saving features offered by these complicated handling techniques, there is always a chance that the extra cable portion will become twisted or entangled within the drill pipe. Moreover, since additional cable sections are coupled to the main cable, there will be an increasing number of electrical connectors in the drill string which are subjected to the adverse effects of the drilling mud passing through the drill string.

To avoid the handling problems presented by a cable that is loosely disposed within a pipe string, it has also been proposed to provide an electrical conductor that is secured to or mounted in the wall of each pipe joint.

For example, as shown in U.S. Pat. No. 2,748,358, a short length of electrical cable is arranged in each pipe joint and supported therein by way of an electrical connector that is coaxially mounted in an upstanding position just inside of the female or so-called "box end" of the pipe joint. The lower end of the cable is unrestrained and is allowed to hang just below the so-called "pin end" of the pipe joint so that the electrical connectors can be mated and the pipe string assembled or disassembled without unduly disturbing the cable lengths or their mated connectors. Similar arrangements are disclosed in U.S. Pat. Nos. 3,184,698 and 3,253,245. Another proposed arrangement shown in U.S. Pat. No. 4,399,877 utilizes a so-called "side-entry sub" which is coupled in the pipe string and has an opening in one side wall through which an electrical cable can be passed.

In the systems shown in the several aforementioned patents, their respective electrical connectors must be manually connected as pipe string is moved into the well bore. To avoid wasting the time required for manually connecting a large number of connectors, as shown in U.S. Pat. Nos. 4,095,865 and 4,220,381, it has been proposed to also provide mating contacts in the ends of each of the pipe joints which will be automatically connected as the pipe joints are coupled together. With either of these design arrangements, it will, of course, be appreciated that there is always a substantial risk that one or more of the connectors required to interconnect so many short cables will be adversely affected by the well bore fluids.

In view of the many problems typically associated with electrical connectors, it has been proposed to instead provide inductive couplings on the opposite ends of the pipe joints for interconnecting the cables in each pipe joint. U.S. Pat. No. 2,379,800, for example, shows a typical set of induction coils that are respectively wound on annular soft-iron cores mounted in opposing recesses on the ends of each joint and cooperatively arranged so that whenever the pipe joints are tandemly coupled together each pair of coils will provide a transformer coupling between the cables in those pipe joints. U.S. Pat. No. 3,090,031, for example, attempts to overcome the inherently-high losses of conventional transformer couplings within typical oilfield piping by providing an encapsulated transistorized amplifier and power source at each associated pair of inductive windings.

To avoid the various problems discussed above, it has also been proposed to mount one or more measuring devices in the lower end of the pipe string and inductively couple these devices to an electrical cable that is lowered through the pipe string to the downhole measuring devices. For instance, as seen in FIGS. 2 and 7 of U.S. Pat. No. 2,370,818, a measuring device which is mounted in a drill collar coupled to the lower end of the drill string is provided with an output coil that is coaxially disposed in an annular recess around the inner wall of the drill collar. The output signals are transmitted to the surface by way of an electrical cable having a matching coupling coil on its lower end that is wound around a central ferromagnetic core member arranged to be complementally fitted into the output coil on the measuring device.

U.S. Pat. No. 3,209,323 disclosed a similar measuring system having a measuring device which is adapted to be mounted on the lower end of a drill string and cooperatively arranged for transmitting signals to and from the surface by way of a matched pair of induction coils which are respectively arranged within an upstanding fishing neck that is coaxially disposed in the drill collar on top of the measuring device and a complementally-sized overshot that is dependently suspended from a typical electrical cable. Although this particular arrangement eliminates many of the problems discussed above, it will be recognized that since these induction coils are surrounded by thick-walled drill pipe, a significant amount of electrical energy that could otherwise be transferred through these coils will instead be dissipated into the electrically conductive pipe. Thus, it will be appreciated by those skilled in the art that this prior-art arrangement, the unavoidable loss of electrical energy will be so great that the system simply cannot transmit signals to and from the surface unless these coils are closely fitted together. This need for a close fit between these induction coils will, therefore, make it difficult to lower the overshot through the drill string with any assurance that it can be reliably positioned around the fishing neck. Moreover, in those situations where well bore debris has accumulated around the upstanding fishing neck on the measuring device before the overshot is lowered into the drill string, the debris could make it difficult or impossible to properly position the overshot on the fishing neck.

The various problems associated with the several data-transmission systems discussed in the aforementioned patents are similar in many respects to the problems associated with coupling a surface power source to a typical oilfield perforating device. Accordingly, as seen in U.S. Pat. No. 4,544,035, a perforating gun that is adapted to be run into a well on the lower end of a tubing string is provided with an inductive coupling arangement that is generally similar to the coupling arrangement disclosed in the above-mentioned U.S. Pat. No. 3,209,323.

Despite the proliferation of patents involving various systems of this nature it is readily apparent to those skilled in the art that none of the systems discussed above for transmitting signals and/or power between the surface and downhole devices in a pipe string have been commercially successful. Instead it has been necessary heretofore either to use a continuous electrical cable that is directly connected to the downhole equipment for transmitting data and power or to utilize a so-called measuring-while-drilling or "MWD" tool with a self-contained power supply which is cooperatively arranged for sending data to the surface by transmitting acoustic signals through the drill string fluid.

OBJECTS OF THE INVENTION

Accordingly, it is an object of the present invention to provide new and improved apparatus for reliably transmitting power and/or data between the surface and well bore apparatus.

It is a further object of the invention to provide new and improved well bore apparatus having electromagnetic coupling means cooperatively arranged for efficiently transferring power and/or data between one or more surface and downhole electrical devices without unduly restricting the passage of other well bore equipment or treatment fluids through the downhole apparatus.

SUMMARY OF THE INVENTION

This and other objects of the present invention are attained by providing well bore apparatus with new and improved electromagnetic coupling means having inner and outer induction coils which are cooperatively arranged and adapted so that one of the coils can be dependently suspended from a well bore cable and connected to electrical conductors therein whereby the one coil can be moved between a remote position separated from the other coil to a selected operating position in a well bore where the coils will be coaxially disposed in relation to one another for inductively coupling surface equipment connected to the cable conductors to well bore apparatus connected to the other coil. The coils are uniquely arranged on inner and outer cores formed of suitable ferrite materials thereby enabling these coils to be radially spaced by a substantial distance from each other as well as to tolerate extreme radial and longitudinal misalignments without unduly affecting the efficient transfer of electrical energy between the surface and well bore apparatus.

BRIEF DESCRIPTION OF THE DRAWINGS

The novel features of the present invention are set forth with particularity in the appended claims. The invention, together with further objects and advantages thereof, may be best understood by way of illustration of the following description of exemplary apparatus employing the principles of the invention as illustrated in the accompanying drawings, in which:

FIG. 3 is a schematic diagram of typical surface and sub-surface equipment such as may be used in conjunction with the well bore apparatus shown in FIGS. 2A–2C; and FIG. 4 depicts a typical voltage waveform that may appear across the new and improved coupling means of the present invention during the course of a typical operation of the well bore apparatus shown in FIGS. 2A–2C.

DETAILED DESCRIPTION OF THE INVENTION

Figure 1:
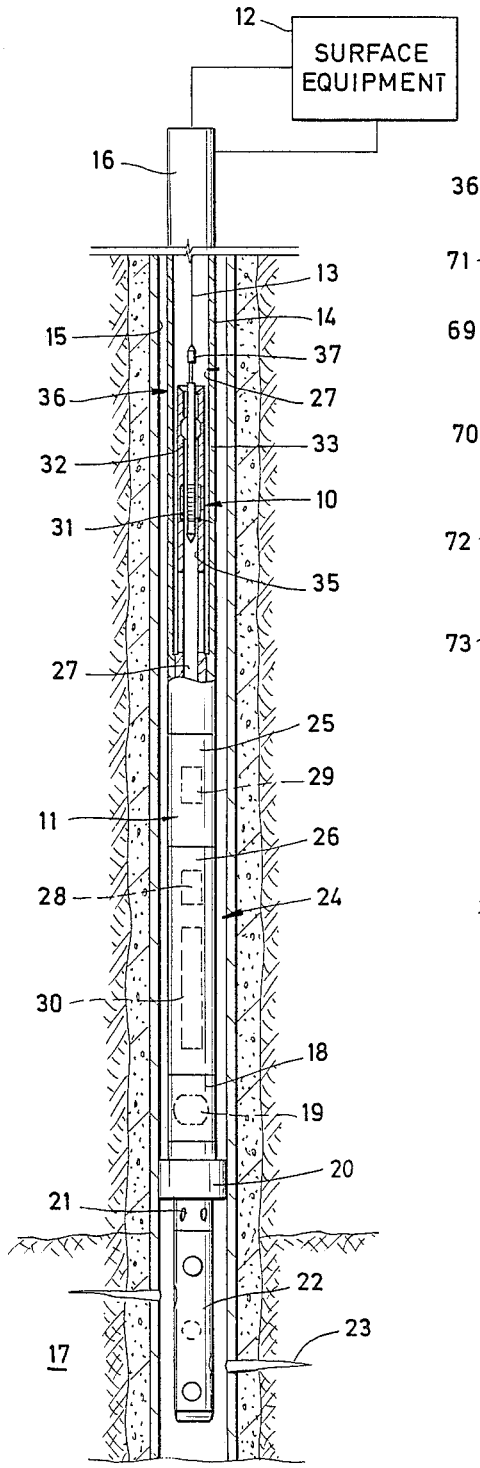
FIG. 1 schematically illustrates new and improved coupling means arranged in accordance with the principles of the present invention and which is depicted as it may be typically employed with an inner portion of the coupling means dependently coupled to the lower end of a typical suspension cable which has been lowered into a cased well bore for cooperatively positioning the inner portion of the coupling means within an outer portion thereof mounted on top of typical well bore apparatus that has been previously positioned in the well bore.

Turning now to FIG. 1, a preferred embodiment of the new and improved coupling means 10 of the present invention is schematically depicted as it may appear when used for coupling a typical sub-surface device or well bore tool 11 to its related surface equipment 12 that are interconnected by a typical well bore suspension cable 13 that is suited for transmitting power and/or electrical data or control signals between the sub-surface and surface apparatus. It must, however, be understood that the coupling means 10 of the present invention may be cooperatively employed with any suitable electrical cable for interconnecting various types of sub-surface devices and their associated surface equipment.

To illustrate a typical situation in which the coupling means 10 may be effectively utilized, the sub-surface apparatus 11 is shown as comprising a typical tubing-conveyed perforating and testing tool such as described, for example, in U.S. Pat. No. 4,509,604. As is customary with such tubing-conveyed tools, the tool 11 was previously coupled to the lower end of a joint of steel tubing 14 which was then lowered into a cased well bore 15 by successively assembling a tubing string 16 from a sufficient number of joints for positioning the perforating and testing tool adjacent to an earth formation 17 containing producible connate fluids. As depicted, the tool 11 includes a test valve assembly 18 (such as shown in U.S. Pat. No. Re. 29,638) that has a full-bore valve element 19 which is selectively opened and closed in response to changes in the pressure of the fluids in the well bore 15 for controlling fluid communication through the tool and tubing string 16.

The lower end of the test valve 18 is cooperatively arranged to be coupled to a full-bore packer 20. Those skilled in the art will, of course, appreciate that for the preferred arrangement of the tool 11, the packer 20 is a permanent packer having normally-retracted slips and packing elements that is set in the cased well bore 15 just above the formation 17. With the depicted arrangement, once the packer 20 has been independently set in the well bore 15, the perforating and testing tool 11 is lowered into the well bore. As is typical, once the tool 11 has reached the packer 20, the valve 18 is fluidly coupled thereto by means such as a reduced-diameter seal nipple (not illustrated) that is dependently coupled to the test valve and adapted to be sealingly disposed within an upwardly-opening seal bore in the packer mandrel.

As depicted, the perforating and testing tool 11 also includes a slotted tail pipe 21 that is dependently coupled below the reduced-diameter seal nipple and appropriately arranged for dependently supporting a perforating gun 22 carrying one or more typical perforating devices such as shaped charges (not depicted) which, when detonated, will produce a corresponding number of perforations, as at 23, for communicating the earth formation 17 with the isolated interval of the well bore 15 below the packer 20. It will, of course, be realized that once the perforating gun 22 has been actuated, the test valve 18 is then selectively operated for controlling the fluid communication between the isolated interval of the well bore 15 and the tubing string 16.

To illustrate a typical situation in which the coupling means 10 may be effectively utilized, the perforating and testing tool 11 is depicted as including measurement means, as generally indicated at 24, preferably arranged in one or more thick-walled tubular bodies 25 and 26 tandemly coupled between the lowermost pipe joint 14 and the test valve 18. As is typical, the various components of the measurement means 24 are cooperatively arranged in the walls of the tubular bodies 25 and 26 thereby providing an unobstructed or so-called "full-bore" flow passage 27 through the full length of the tool 11.

It should be appreciated that since the coupling means 10 of the present invention are not limited to only certain types of measurements, the measurement means 24 may include one or more typical measuring devices and associated electronic circuitry, as at 28, adapted for measuring such fluid properties or well bore characteristics as the pressures and/or temperatures of fluids above and below the packer 20 as well as the conductivity, flow rate and density of these fluids. The measurement means 24 may include batteries 29 for powering the measuring devices and their circuitry 28 as well as one or more self-contained recorders 30 for recording the output data from these devices over extended periods.

As will be subsequently described in greater detail by reference to FIGS. 2A–2C, the preferred embodiment of the new and improved coupling means 10 of the present invention includes a unique outer coil assembly 31 cooperatively arranged in the upper portion of the perforating and testing tool 11. Although the coil assembly 31 could be suitably mounted in the upper end of the thick-walled tubular body 25, it is preferred to instead arrange the outer coil assembly within a reduced-diameter tubular member 32 having a longitudinal bore defining an extension to the axial passage 27 through the bodies 25 and 26. The member 32 is coaxially mounted in an outer tubular body 33 having an enlarged bore that is appropriately sized for cooperatively positioning the outer coil assembly 31 around the axial passage 27 as well as for providing a fluid bypass passage 34 around the coupling means 10. One or more electrical conductors (not seen in FIG. 1) are disposed in one or more interconnecting passages (not depicted) in the bodies 25, 26 and 32 and cooperatively arranged to connect the outer coil assembly 31 in the upper body to the components of the measurement means 24 in the lower bodies.

The coupling means 10 also include a unique inner coil assembly 35 coaxially mounted on a wireline-supported tool or so-called "running tool" 36 that is sized to pass freely through the tubing string 16 and the respective portions of the axial passage 27 through the tubular bodies 25, 26 and 32. The running tool 36 is arranged to be dependently coupled by a typical cable head 37 to the lower end of the suspension cable 13 that is spooled on a winch (not illustrated in FIG. 1) located at the surface and arranged for moving the running tool through the tubing string 16 between the surface and its depicted operating position in the inner body 32 where the inner coil assembly 35 is positioned in effective electromagnetic inductive proximity of the outer coil assembly 31. One or more conductors (not shown in FIG. 1) are arranged in the running tool 36 for cooperatively connecting the inner coil assembly 35 to the conductors in the suspension cable 13 to electrically interconnect the running tool and the surface equipment 12.

Figure 2C:
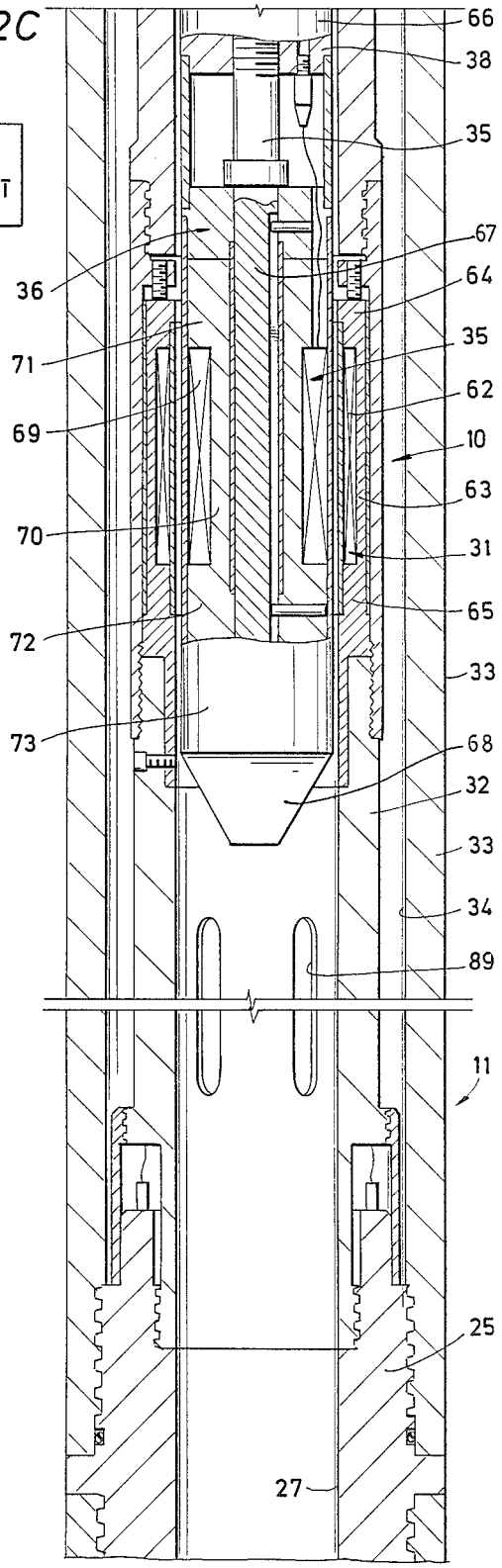
FIGS. 2A–2C are successive cross-sectional views of a preferred embodiment of well bore apparatus employing the new and improved coupling means of the invention.
Figure 2A:
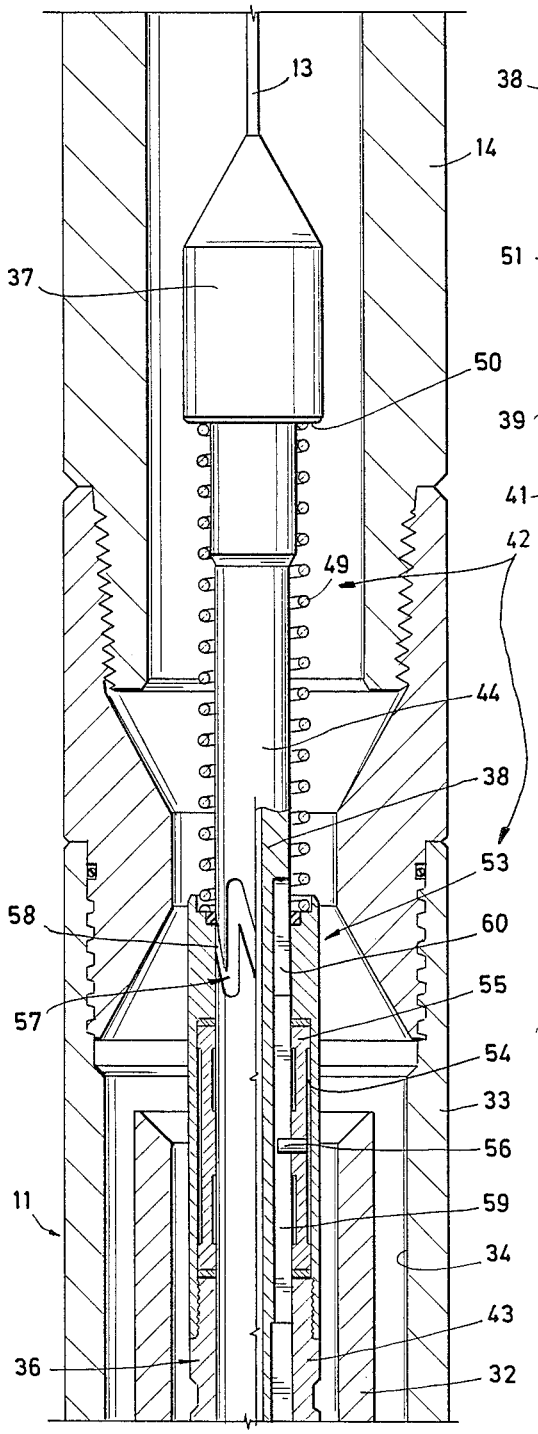
Figure 2B:
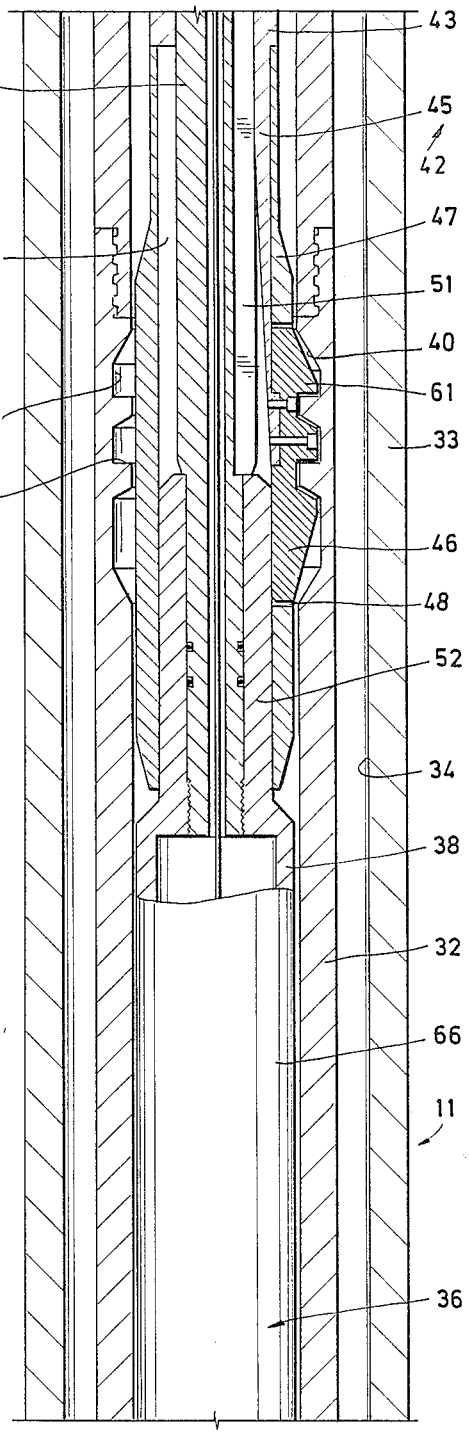

Turning now to FIGS. 2A–2C, successive longitudinal cross-sectional views are shown of a preferred embodiment of the coupling means 10 of the invention. As seen generally at 38, the running tool 36 includes an elongated body which extends the full length of the tool. It will, of course, be appreciated by those skilled in the art that to simplify the fabrication as well as the assembly and maintenance of the running tool 36, the body 38 is necessarily comprised of a plurality of individual components or interconnected assemblies.

It will, of course, be appreciated that whenever there is a significant upward flow of fluids through the tubing string 16, such as when connate fluids are being produced from the earth formation 17 (FIG. 1), the wireline tool 36 must be releasably secured in its established operating position in the tubular body 32 to be certain that the coil assemblies 31 and 35 are reliably maintained in effective electromagnetic inductive proximity in relation to each other. Accordingly, in the preferred embodiment of the coupling means 10 of the invention depicted in FIGS. 2A–2C, as shown generally at 39 an inwardly-facing recess is formed around the internal wall of the tubular body 32 and appropriately configured for defining one or more spaced opposed shoulders 40 and 41 that are located a predetermined distance above the outer coil assembly 31.

The wireline-supported tool 36 is further provided with selectively-operable anchoring means 42 that are cooperatively arranged and adapted to releasably secure the wireline tool in the inner tubular body 32. In the preferred embodiment of the running tool 36 shown in FIGS. 2A–2C, the anchoring means 42 include an elongated sleeve 43 that is slidably mounted around a reduced-diameter portion 44 of the tool body 38 and secured from rotating in relation thereto in a typical fashion by one or more keys or splines and mating longitudinal grooves (not seen in the drawings) on the inner and outer members. The lower end of the elongated sleeve 43 is cooperatively arranged for supporting two or more depending flexible collet fingers 45 which are spatially disposed around the tool body 38. Although separate fingers may be mounted on the sleeve 43, the collet fingers 45 are preferably arranged as depending integral extensions of the sleeve which are formed by cutting away sufficient metal from the lower portion of the inner sleeve to enable the fingers to flex inwardly. Lugs or flat keys 46 are respectively secured in upright positions on the free ends of the fingers 45, with the outer edges of these keys being appropriately shaped to be complementally fitted within the inwardly-facing recess 39 whenever the wireline coupling tool 36 is positioned within the tubular body 32. To prevent the keys 46 from being twisted or tilted relative to their respective collet fingers 45, a protective outer sleeve 47 having a corresponding number of longitudinal slots 48 is coaxially mounted around the inner sleeve 43 and the keys are respectively arranged in these slots for moving laterally between their illustrated normal or "extended" positions where the shaped outer edges of the keys are projecting beyond the external surface of the outer sleeve and a "retracted" position where the outer edges are fully confined within the outer sleeve.

As shown in FIGS. 2B, the anchoring means 42 further include biasing means such as an elongated coil spring 49 that is cooperatively arranged between the inner sleeve and a shoulder 50 on the upper end of the body 38 for urging the sleeves 43 and 47 downwardly in relation to the body from an elevated "running-in" position toward the lower "locking" position illustrated in the drawings whenever the sleeves are free to move in relation to the tool body. The portion of the tool body 38 that will be disposed immediately behind the keys 46 whenever the sleeves 43 and 47 are elevated running-in position is reduced or recessed by providing a corresponding number of outwardly-opening longitudinal grooves 51 that are respectively adapted to receive the rearward portions of the keys and the flexible collet fingers 45 whenever they are forced inwardly from their extended positions to their respective retracted positions in the grooves. On the other hand, it will be further appreciated from FIG. 2B that whenever the biasing action of the spring 50 has shifted the sleeves 43 and 47 further downwardly along the tool body 38, the rearward edges of the keys 46 will then be positioned directly over an enlarged portion 52 of the tool body that is cooperatively sized to prevent the keys from moving inwardly toward the tool body. Accordingly, whenever the sleeves 43 and 47 are in their elevated position, the collet fingers 45 can deflect inwardly for retracting the keys 46 from the recess 39 in the tubular body 32; but whenever the sleeves are in their lower "locking" position, the keys are blocked from moving out of the recess.

The anchoring means 42 further include means, such as shown generally at 53, selectively operable from the surface for controlling the movement of the inner sleeve 43 in relation to the tool body 38. Accordingly, in the preferred embodiment of the wireline tool 36, an inwardly-facing annular recess 54 is arranged in the inner sleeve 43 for rotatably supporting a short sleeve 55 carrying an inwardly-directed J-pin 56 that is movably disposed in a typical continuous J-slot system 57 cooperatively arranged on the adjacent surface of the tool body 38. Those skilled in the art will, of course, appreciate that when the keys 46 are disposed within the recess 39 in the tubular body 32, the sleeves 43 and 47 are secured against moving longitudinally with respect to the tool body 38 and the weight of the tool body will be fully supported by the spring 49 when tension is removed from the cable 13. Thus, by operating the winch (not depicted in the drawings) at the surface to slack off the suspension cable 13, as the tool body 38 is moved downwardly, a first inclined portion 58 of the continuous J-slot system 57 is shifted along the J-pin 56 and thereby turns the sleeve 55 in relation to the tool body 38 from its depicted angular position to a second angular position where the J-pin is then positioned above the upper end of an elongated longitudinal portion 59 of the J-slot system. At that angular position of the sleeve 55, when tension is applied to the cable 13, the biasing action of the spring 49 will then shift the outer sleeves 43 and 47 and the collet fingers 45 downwardly as the tension on the cable simultaneously moves the tool body 38 upwardly in relation to the J-pin 56. Once this takes place, the wireline tool 36 will be locked in position within the tubular body 32 so long as tension is maintained on the suspension cable 13.

It will, however, be appreciated that the wireline tool 36 can be released by simply slacking off the suspension cable 13 so that the weight of the running tool will again be supported on the spring 49. Once this takes place, the weight of the tool 36 is sufficient to move the tool body 38 downwardly in relation to the sleeves 43 and 47 which will again position the enlarged body portion 52 below the slots 48 so that the rearward edges of the collet fingers 45 and the keys 46 are again free to be retracted into the recesses 51. As the tool body 38 moves downwardly, a second inclined portion 60 of the J-slot system 57 functions for turning the sleeve 55 to a third angular position where the J-pin 56 is positioned in the upper end of the second inclined portion. Once the J-pin 56 is in this portion 60 of the J-slot system 57, reapplication of tension on the cable 13 will again rotate the sleeve 55 to its initial position and thereby return the J-pin 56 to the first portion 58 of the J-slot system 57. Once the sleeve 55 is in its initial angular position, the collet fingers 45 and the keys 46 are able to be retracted. Thus, whenever tension is applied to the suspension cable 13, the upper inclined shoulders 61 of the keys 46 will engage the opposed surfaces 40 in the body 32 and urge the keys inwardly as the wireline running tool 36 is initially moved upwardly in the pipe string 16 to return the tool to the surface.

Turning now to FIG. 2C, the lower portion of the subsurface apparatus 11 shows a preferred arrangement of the outer and inner coil assemblies 31 and 35 of the coupling means 10 of the present invention. As previously discussed, the outer coil assembly 31 is cooperatively mounted in a tubular body or sub 32 that is tandemly coupled in the tubing string 16, with the coil assembly being coaxially disposed around the axial passage 27 in the body. In the preferred embodiment of the outer coil assembly 31, a multi-turn winding 62 of an insulated conductor or wire is arranged in one or more layers of uniform diameter inside of a unique tubular core 63 having enlarged-diameter upper and lower end pieces 64 and 65. The core 63 and its end pieces 64 and 65 are disposed in a complementary inwardly-opening recess in the internal wall of the tubular sub 32 and securely mounted therein. Although electrical insulation is not required, it is preferred to secure the core pieces 63–65 in the sub 32 by means such as a non-conductive potting compound.

As depicted in FIGS. 2B and 2C, the lower portion of the tool body 38 is comprised of a tubular housing 66 which is cooperatively arranged for sealingly enclosing the electronic circuitry of the wireline tool 36 as well as for dependently supporting a reduced-diameter rod or axial member 67 on which the inner coil assembly 35 is cooperatively mounted. It should be noted that because of the unique electromagnetic characteristics of the coupling means 10, the support member 67 may be formed of steel or any material considered to have sufficient strength to withstand severe impact forces as the running tool 36 is lowered into a well bore such as the cased well bore 15. A suitable nose piece 68 is arranged on the lower end of the support rod 67 so as to serve as a guide for the tool 36.

In the preferred embodiment of the inner coil assembly 35, a multi-turn winding 69 of a suitable conductor or insulated wire is wound in one or more layers of uniform diameter around the mid-portion of an elongated, thick-walled tubular core member 70 that is coaxialy disposed around the reduced-diameter support member 67 and secured thereon between upper and lower end pieces 71 and 72. A tubular shield 73 of a non-magnetic material such as an electrically non-conductive reinforced plastic is coaxially disposed around the inner coil assembly 35 and suitably arranged for physically protecting the coil. Although this shield 73 must be formed of a non-magnetic material, it can also be fabricated from an electrically-conductive metal such as aluminum, stainless steel or brass that is preferably arranged in a fashion as to not short circuit the inductive coupling between the coil assemblies 31 and 35. Those skilled in the art will also appreciate that if the shield 73 is made of metal, a plurality of circumferentially-spaced longitudinal slits should be arranged around the shield to at least reduce, if not prevent, power losses from unwanted eddy currents.

It is of particular significance to note that with the coupling means 10 of the present invention it is not essential to position the inner coil assembly 35 in close radial proximity to the outer coil assembly 31 as would otherwise be the case with a prior-art inductive-coupling device such as any of those devices discussed above. Instead, those skilled in the art will realize from FIG. 2C that the annular clearance space between the two coil assemblies 31 and 35 is significantly greater than would be considered feasible for efficiently transferring electrical energy between prior-art coil assemblies using conventional core materials. To achieve efficient energy transfer with substantial clearances between two coil assemblies as at 31 and 35, it has been found that a significant increase in the electromagnetic inductive coupling between the coil assemblies is attained by forming inner and outer cores, such as shown at 63 and 70, of typical ferrite materials having a curie temperature point that is at least equal to or, preferably, somewhat greater than the anticipated maximum subsurface or well bore temperature at which the coupling means 10 will be expected to operate.

In marked contrast to the core materials typically used heretofore for prior-art inductive couplings such as described in U.S. Pat. No. 3,209,323, the ferrite core materials used in the practice of the invention have a high DC bulk resistivity, a very low magnetic remnance and a moderate magnetic permeability. It will, of course, be appreciated by those skilled in the art that ferrites are ceramic magnetic materials that are formed of ionic crystals having the general chemical composition $(Me)Fe_2O_3$, where (Me) represents any one of a number of metal ions selected from a group consisting of manganese, nickel, zinc, magnesium, cadmium cobalt and copper. Examples of typical ferrites considered to be suitable for the coupling means 10 to be effective for use in commercial downhole service are those formed from one or more of the first three of those ions and having a bulk resistivity greater than 10,000 ohm-meters.

One ferrite material which has been used to fabricate a preferred embodiment of the outer and inner coil assemblies 31 and 35 of the present invention is composed of eighteen percent zinc oxide, thirty two percent nickel oxide and fifty percent iron oxide which was prepared and converted in accordance with well-known processes into that particular ferrite by controlled high temperatures to form a polycrystaline structure resembling spinel and in which the transitional metal ions are separated by oxygen ions. The magnetic permeability of this ferrite material is approximately one hundred to two hundred times greater than the permeability of free space and its DC bulk resistivity is in excess of one million ohm-meters. This preferred material also has a particularly low magnetic remnance. Since this particular ferrite has a curie temperature in excess of 250-degrees Celsius (i.e., 480-degrees Fahrenheit), it will be appreciated that these respective performance characteristics will be exhibited at any well bore temperature up to that temperature. It has been found that with this and other similar ferrites, the new and improved coupling means 10 of the invention will operate efficiently and with stability over a wide frequency band extending from only a few Hertz to several Megahertz.

It should be noted that where ferrites such as the one described above further include up to about ten percent zirconia in a crystalline or uncrystalline form, the toughness, mechanical strength and corrosion resistance of the material will be greatly improved without affecting the electrical or magnetic properties of the ferrite material. Thus, where there is a possibility that the new and improved coupling means 10 of the invention might be subjected to subtantial vibrational or impact forces, ferrites including zirconia should be considered at least for the outer coil assembly as at 31. For instance, a typical situation where such ferrites might be considered is where the new and improved coupling means 10 is to be employed to transfer electrical power and/or data between surface equipment and one or more downhole sensors, recorders or measuring devices in a drill string which will be temporarily halted from time to time to enable a cable-suspended device such as the running tool 36 to be moved through the drill string to the downhole device.

Turning now to FIG. 3, a schematic diagram is shown of typical electronic circuitry which may be used in conjunction with the new and improved coupling means 10 of the invention for interconnecting the downhole tool 11 to the surface equipment 12. As depicted, the surface equipment 12 includes a typical computer 74 which is coupled to the surface ends of the conductors 75 and 76 in the suspension cable 13 by way of a typical AC/DC separator and combiner 77. As is typical, a signal driver 78 is coupled between the computer 74 and the combiner 77 and is cooperatively arranged for selectively transmitting signals from the surface equipment 12 to the downhole tool 11. In a similar fashion, a signal detector 79 is arranged between the computer 74 and the combiner 77 for receiving signals from the subsurface equipment 11 and cooperatively converting those signals into appropriate input signals for the computer. The surface equipment 12 also may include a power supply 80 that, for example, would be capable of supplying power to the sub-surface equipment for firing the perforating gun 22 as well as for operating any other device in the equipment 11.

As previously described by reference to FIG. 2C, the downhole running tool 36 is dependently suspended from the cable 13 and the inner coil assembly 35 in the tool is cooperatively connected to the conductors 75 and 76 in the suspension cable. In the preferred embodiment of the running tool 36, the cable conductors 75 and 76 are connected to the coil assembly 35 by a wireline receiver/driver and a DC/DC converter in an enclosed cartridge 90 which are cooperatively arranged for providing a suitable interface between the suspension cable 13 and the coil winding 69. In the illustrated embodiment of the sub-surface equipment 11, the outer coil assembly 31 is cooperatively coupled to the downhole measurement means 24 by a typical frequency-shift keying demodulator 81 and a synchronous pulse driver 82 that are in turn coupled to a typical microprocessor or computer 83 by way of a universal asynchronous receiver-transmitter 84. To supply power from the surface equipment 12 to one or more devices in the sub-surface equipment 11, a rectifier 85 is connected across the winding 62 of the outer coil assembly 31 and operatively arranged to be driven when it is desired to supply power to those devices. As previously mentioned, the self-contained battery 29 may also be appropriately arranged for supplying power to one or more of the components of the downhole equipment 11. Since it may also be desired to recharge the battery 29 while it is still downhole, the rectifier 85 is also preferably arranged to be utilized for recharging the battery.

Those skilled in the art will, of course, appreciate that the tubing-conveying perforating gun 22 may be actuated in various ways. For instance, as described in more detail in the aforementioned U.S. Pat. No. 4,509,604, the perforating gun 22 may be selectively fired by varying the pressure of the fluids in the upper portion of the cased well bore 15 above the packer 20. There are also other firing systems employing a so-called "drop bar" that is introduced into the surface end of the supporting pipe string with the expectation being that the falling bar will strike an impact-responsive detonator with sufficient force to actuate a perforating gun such as the gun 22. Other systems that have been proposed involve an inductive coupling which, as fully described in U.S. Pat. No. 4,544,035, is arranged on the lower end of a well bore cable for coupling a surface power source to the perforating gun. There have also been proposals to combine two or more firing systems so as to have an alternative firing system when possible.

Accordingly, it will be appreciated that the new and improved coupling means 10 of the present invention are uniquely arranged to provide an alternative firing system should the gun 22 fail to fire in response to varying the pressure in the cased well bore 15 as described in U.S. Pat. No. 4,509,604. As shown in FIG. 3, a typical driver 86 may be coupled to the downhole computer 83 and cooperatively arranged to selectively control a typical relay 87 coupling an electrically-responsive detonator 88 to the winding 62 of the outer coil assembly 31. In this manner, when the computer 74 at the surface is operated to send a proper command signal to the downhole computer 83, the relay 87 will be closed so as to couple the detonator 88 to the power supply 80 at the surface. The surface power supply 80 is, of course, operated as needed to fire the gun 22.

To illustrate the operation of the circuitry depicted in FIG. 3, FIG. 4 shows a representative pulsating DC voltage waveform as would commonly appear across the winding 62 of the outer coil assembly 31 during normal operation of the new and improved coupling means 10 of the present invention. In keeping with the previous description of the downhole circuitry depicted in FIG. 3, DC power from the power supply 80 is transmitted by way of the cable 13 of the electronic cartridge 90 where typical switching power supply circuitry functions for converting the DC power into a pulsating DC voltage that will be supplied to the downhole electronic circuitry in the sub-surface equipment 11 by way of the inductive coupling between the coil assemblies 31 and 35 of the new and improved coupling means 10. The rectifier 85, of course, functions to convert the pulsating DC voltage that is transferred across the coil assemblies 31 and 35 to the voltage required by the equipment 11.

It will, of course, be understood by those skilled in the art that data communication between the sub-surface equipment 11 and the surface equipment 12 can be carried out in any one of various manners. Nevertheless, with the preferred embodiment of the electronic circuitry shown in FIG. 3, communication between the sub-surface equipment 11 and the surface equipment 12 employs a typical system of bipolar modulation which is half duplex by nature. As schematically represented in FIG. 4, the wireline receiver/driver and DC/DC converter in the enclosed cartridge 90 are cooperatively arranged to normally produce a typical square-wave output waveform across the winding 62. Data communication between the circuitry in the cartridge 90 and the circuitry in the sub-surface equipment 11 is carried out by way of typical frequency-shift keying techniques or so-called "FSK" modulation of the DC waveform. Data communication in the opposite direction between the electronic circuitry in the sub-surface equipment 11 and the cartridge 90 is preferably carried out by using typical synchronous impedance modulation of the DC waveform. With this technique, the driver 82 is selectively operated for applying significant impedance changes across the winding 62 of the outer coil assembly 31. For example, as seen in FIG. 4, to signal one binary bit, the driver 82 is operated to create a momentary short circuit across the winding 62 during a positive-going half cycle 91 of the waveform. This momentary short circuit will, of course, temporarily reduce or cut off the voltage across the winding 62 for a predetermined period of time as depicted by the voltage excursions shown at 92 and 93. In a similar fashion, the opposite binary bit is represented by operating the driver 82 to momentarily reduce the volate across the winding 62 during a negative-going half cycle of the DC waveform for a predetermined period as depicted by the voltage excursions shown at 95 and 96. The operating frequency for the illustrated circuitry is between twenty to one hundred Kilohertz. A tyipcal period for operating the driver 82 to produce the depicted voltage excusions as, for example, between the excursions 92 and 93 is approximately twenty to thirty percent of the time for a half cycle.

If will, of course, be recognized that the power supply 80 in the surface equipment 12 can be arranged to also provide a source of AC voltage. Accordingly, the new and improved coupling means 10 can also be adapted for efficiently transferring power between the surface equipment 12 and the peforating gun 22. To carry this out, the power supply 80 is arranged to operate in a frequency range between one hundred to one thousand Kilohertz and provide an output voltage of up to eight hundred volts RMS with an output current of at least one ampere. Thus, by choosing an output frequency that is optimized in relation to the particular suspension cable as at 13 being used for a perforating operation, there will be an efficient transfer of electrical energy between the power supply 80 and the detonator 88. This optimum frequency is such that the effective input impedance of the coil 69 will be approximately equal to the mathematical complex conjugate of the characteristic impedance of the suspension cable as at 13. It should, of course, be recognized that since the new and improved coupling means 10 exhibits low losses and stable characteristics over a wide frequency range, the optimization of frequency can be utilized for optimizing the transfer of electrical power across the new and improved coupling means 10 for a wide variety of well bore cables such as typical armored single-conductor cables or so-called "monocables" or typical multi-conductor cables. It will, therefore, be appreciated that this optimized transfer of electrical energy can also be achieved wholly independently of the electronic circuitry shown in FIG. 3 where there is no need to transmit data between the surface and the downhole equipment. Thus, should the downhole equipment consist only of a perforating gun, the detonator (as at 88) can be connected directly across the winding 62 of the outer coil assembly 31 without any other downhole electrical or electronic components being required.

It will also be recognized by those skilled in the art that the new and improved coupling means 10 do not obstruct the axial flow passage 27 through the entire length of the downhole tool 11. Once the perforator 22 is actuated to establish fluid communication between the earth formation 17 and the cased well bore 15 below the packer 20, connate fluids can flow easily into the isolated portion of the well bore and pass directly through the flow passage 27 to the tubing string 16. When the running tool 36 is lowered through the tubing string 16 and moves into the tubular body 32, the collet fingers 45 and the lugs 46 will function as previously described to enter the recess 39. Then, once tension is applied to the suspension cable 13, the body 38 will be pulled upwardly in relation to the sleeves 43 and 47 to allow the enlarged-diameter body portion 52 to move behind the collet fingers 45. As previously described, this will lock the running tool 36 in the tubular member 32. It will be recognized that once the tool 36 is locked into position, fluid flow will be diverted around the tool by way of one or more bypass ports 89 in the lower end of the tubular member 32 which thereby communicates the axial bore 27 in the body 25 with the annular bypass passage 34 defined around the tubular member 32.

It will be appreciated that the running tool 36 may be used in various ways. For instance, the running tool 36 may be positioned in the tubular member 32 and the surface computer 74 operated as required for connecting one or more of the several sensors 28 with the surface computer for obtaining a series of real-time measurements of the output signals provided by these sensors. Communication between the downhole equipment 11 and the surface equipment 12 will, of course, be carried out in keeping with the previous descriptions of FIGS. 3 and 4. In a similar fashion, the wireline running tool 36 may be positioned from time to time in the tubular member 32 and the surface computer 74 operated for coupling the downhole recorder 30 with the surface computer. Thereafter, the surface computer 74 may be operated as required to interrogate the downhole recorder 30 and utilize the above-described communication techniques for transferring data that has been previously stored on the downhole recorder to the memory of the surface computer while the running tool 36 was not positioned in the downhole equipment 11. It should be recalled as well that the wireline tool 36 may be utilized as needed for recharging the downhole battery 29 as well as for operating the perforating gun 22. Accordingly, it will be appreciated that the present invention has provided new and improved apparatus for conducting various testing and completion operations including unique coupling means adapted to be coupled to the lower end of a typical well bore suspension cable for transferring electrical data and/or power between the surface and downhole apparatus in a well bore.

While only one particular embodiment of the invention has been shown and described herein, it is apparent that changes and modifications may be made thereto without departing from this invention in its broader aspects; and, therefore, the aim in the appended claims is to cover all such changes and modifications as may fall within the true spirit and scope of this invention.

What is claimed is:

1. Well bore apparatus comprising:

a sub-surface tool including a selectively-operable means which includes at least one electrical device;

coupling means including inner and outer telescopically-interfitting coil assemblies, said coil assemblies further including, inner and outer cores formed substantially of ferrite materials having a DC bulk resistivity greater than ten thousand ohm-meters and cooperatively arranged so that said coil assemblies can be telescopically interfitted together, said ferrite material being selected from the group of metal ions consisting of manganese, nickel, zinc, magnesium, cadmium, cobalt, and cooper and having a curie temperature point greater than the maximum anticipated well bore temperature to which said coil assemblies will be exposed, said ferrite materials further including an additive of no more than about ten percent by weight of zirconia in a crystalline or uncrystalline form, and inner and outer coils, disposed within said inner and outer cores, respectively wound around said inner and outer cores and electromagnetically intercoupled to one another whenever said coil assemblies are telescopically interfitted together, means on said tool for retaining one of said coil assemblies in a position in a well bore where it can be telescopically interfitted with the other of said coil assemblies, and means for connecting said coil of said one coil assembly to said electrical device; and means on said other coil assembly for connecting its said coil to the conductors in a suspension cable supporting said other coil assembly for movement in a well bore to said position where said coil assemblies are telescopically interfitted.

2. The well bore apparatus of claim 1 wherein said coil assembly is said outer coil assembly.

3. The well bore apparatus of claim 1 wherein said electrical device is an electrically-actuated detonator.

4. The well bore apparatus of claim 1 wherein said electrical device is a rechargeable battery.

5. The well bore apparatus of claim 1 wherein said electrical device is an electrical sensor.

6. The well bore apparatus of claim 1 wherein said electrical device is an electrically-responsive relay.

7. The well bore apparatus of claim 1 wherein said electrical device is a computer.

8. The well bore apparatus of claim 1 wherein said electrical device is a data recorder.

9. The apparatus of claim 1 wherein said ferrite materials are selected from the group consisting of mangnesium ferrite, nickel-zinc ferrite, iron oxide magnetite and nickel ferrite and having a curie temperature point greater than the maximum anticipated well bore temperatures to which said coil assemblies will be exposed.

10. The apparatus of claim 1 wherein at least one of said cores is formed of a ferrite composed of about eighteen percent zinc oxide, thirty two percent nickel oxide and fifty percent iron oxide.

11. Well bore apparatus comprising:

sub-surface equipment including a tubular body adapted to be coupled into a pipe string and positioned in a well bore;

selectively-operable means on said body including at least one electrical device;

coupling means including inner and outer telescopically-interfitting coil assemblies, said coil asemblies further including, inner and outer core members respectively formed substantially of ferrite materials having a DC bulk resistivity greater than ten thousand ohm-meters and cooperatively sized and arranged so that said coil assemblies can be telescopically interfitted together, said ferrite materials being selected from the group of metal ions consisting of manganese, nickel, zinc, magnesium, cadmium, cobalt and copper and having a curie temperature point greater than the anticipated maximum well bore temperatures to which said coil assemblies will be exposed, said ferrite materials further including an additive of no more than about ten percent by weight of zirconia in a crystalline or uncrystalline form, and inner and outer coils, disposed within said inner and outer core members, respectively wound around said inner and outer core members and electromagnetically intercoupled to one another whenever said coil assemblies are telescopically interfitted together, means for coaxially mounting said outer coil assembly within said body and in position to telescopically receive said inner coil assembly, and means for connecting said outer coil to said electrical device;

means on said inner coil assembly for connecting said inner coil to the conductors in a suspension cable dependently supporting said inner coil assembly for movement through a pipe string in a well bore to a position therein where said inner and outer coil assemblies are telescopically interfitted; and surface equipment connected to the conductors in a suspension cable supporting said inner coil assembly.

12. The well bore apparatus of claim 11 wherein said surface equipment is adapted to be selectively operated for transferring electrical energy through a suspension cable supporting said inner coil assembly when said inner coil assembly is positioned within said outer coil assembly.

13. The well bore apparatus of claim 11 wherein said surface equipment is adapted to be selectively operated for receiving electrical energy being sent from said electrical device through a suspension cable supporting said inner coil assembly when said inner coil assembly is positioned within said outer coil assembly.

14. The well bore apparatus of claim 11 wherein said surface equipment is adapted to be selectively operated for transmitting electrical energy being sent to said electrical device through a suspension cable supporting said inner coil assembly when said inner coil assembly is positioned within said outer coil assembly.

15. The well bore apparatus of claim 11 further including means cooperatively arranged for releasably securing said inner coil assembly in its said position within said body where said inner and outer coil assemblies are telescopically interfitted.

16. The well bore apparatus of claim 11 further including means cooperatively arranged on said body for providing a fluid bypass passage around said inner coil assembly when it is in its said position within said body.

17. The well bore apparatus of claim 11 further including packer means cooperatively arranged on said body and adapted to be set in a well bore for isolating an interval thereof below said body.

18. The well bore apparatus of claim 17 wherein said electrical device is an electrical sensor cooperatively arranged on said body for measuring at least one characteristic of the fluids in such an isolated well bore interval.

19. The well bore apparatus of claim 17 wherein said electrical device is a data recorder; and said well bore apparatus further includes at least one electrical sensor cooperatively arranged on said body for measuring at least one characteristic of the fluids in such an isolated well bore interval and operatively coupled to said data recorder for storing data representative of such fluid characteristics.

20. The well bore apparatus of claim 19 wherein said well bore apparatus further includes a rechargeable battery cooperatively arranged for supplying power to said data recorder and electrical sensor, and means cooperatively arranged for interconnecting said outer coil assembly to said battery when said battery is to be recharged by transmitting power from said surface equipment.

21. The well bore apparatus of claim 17 wherein said electrical device is a computer; and said well bore apparatus further includes a plurality of electrical sensors cooperatively arranged on said body adapted for measuring selected characteristics of the fluids in such an isolated well bore interval respectively coupled to said computer and adapted for being selectively interrogated thereby when signals representative of such fliud characteristics are to be fed to said computer.

22. The well bore apparatus of claim 17 wherein said electrical device is an electrically-actuated detonator; and said well bore apparatus further includes a perforating gun dependently coupled to said body and adapted to be actuated by said detonator.

23. The apparatus of claim 19 wherein at least one of said cores is formed of a ferrite composed of about eighteen percent zinc oxide, thirty two percent nickel oxide and fifty percent iron oxide.

24. Apparatus adapted to be disposed in a well bore for inductively coupling power and data signals between surface equipment and sub-surface equipment, comprising:

a first conductor adapted to be connected to the surface equipment;

a second conductor adapted to be connected to the sub-surface equipment; and coupling means interconnecting said first conductor to said second conductor for conducting said power and data signal between said surface equipment and said sub-surface equipment, said coupling means including, a first coil connected to said first conductor, a second coil connected to said second conductor and coaxially disposed around said first coil, said second coil being inductively coupled with said first coil, and core means disposed within and around said first coil and said second coil for assisting in the inductive coupling of said first coil and said second coil, said core means comprising a specific ferrite material, said specific ferrite material of said core means including ceramic magnetic materials formed of ionic crystals and having the general chemical composition $(Me)Fe_2O_3$, where (Me) is a metal ion selected from a group consisting of manganese, nickel and zinc.

25. The apparatus of claim 24, wherein said specific ferrite material has a curie temperature point that is equal to or greater than an anticipated maximum subsurface temperature within said well bore.

26. The apparatus of claim 25 wherein said specific ferrite material has a high DC bulk resistivity, a low magnetic remnance, and a moderate magnetic permeability.

27. The apparatus of claim 24, wherein the bulk resistivity of the (Me) metal ion is greater than 10,000 ohm-meters.

28. Apparatus adapted for electromagnetically coupling electrical conductors in a well bore suspension cable to well bore apparatus having at least one electrical device and comprising:

inner and outer coil assemblies respectively including, inner and outer core members formed substantially of ferrite materials having a DC bulk resistivity greater than ten thousand ohm-meters and cooperatively arranged so that said inner coil assembly can be telescopically disposed within said outer coil assembly, said core members being formed of ferrites selected from the group of metal ions consisting of manganese, nickel, zinc, magnesium, cadmium, cobalt and copper, said ferrites further including an additive of up to about ten percent by weight of zirconia, and inner and outer coils disposed within said inner and outer core members, respectively wound around said inner core member and inductively coupling the conductors in a suspension cable connected to one of said coils to a well bore electrical device connected to the other of said coils whenever said inner coil assembly is disposed within said outer coil assembly.

29. The apparatus of claim 28 wherein said other coil is said outer coil.

30. The apparatus of claim 28 wherein said core members are formed of ferrites selected from the group consisting of nickel-zinc ferrite, iron oxide magnetite, nickel ferrite and magnesium ferrite and respectively having a curie temperature point that is at least equal to the maximum anticipated well bore temperatures to which said coil assemblies will be exposed.

31. The apparatus of claim 30 wherein said inner and outer core members are respectively formed of the same ferrite material.

32. The apparatus of claim 28 wherein at least one of said core members is formed of a ferrite composed of about eighteen percent zinc oxide, thirty two percent nickel oxide and fifty percent iron oxide.

33. The apparatus of claim 28 wherein said inner and outer core members are respectively formed of a ferrite composed of about eighteen percent zinc oxide, thirty two percent nickel oxide and fifty percent iron oxide.

34. Apparatus adapted for electromagnetically coupling electrical conductors in a well bore suspension cable to well bore apparatus having at least at least one electrical device and comprising:

inner and outer coil assemblies respectively including, inner and outer core members formed substantially of ferrite materials having a DC bulk resistivity greater than ten thousand ohm-meters and cooperatively arranged so that said inner coil assembly can be telescopically disposed within said outer coil assembly, said core members being formed of ferrites selected from the group of metal ions consisting of manganese, nickel, zinc, magnesium, cadmium, cobalt and copper respectively having a curie temperature point that is at least equal to the maximum anticipated well bore temperatures to which said coil assemblies will be exposed, said ferrites further including an additive to the ferrite material of no more than about ten percent by weight of zirconia in a crystalline or uncrystalline form, and inner and outer coils, disposed within said inner and outer core members, respectively wound around said inner core member and inductively coupling the conductors in a suspension cable connected to one of said coils to a well bore electrical device connected to the other of said coils whenever said inner coil assembly is disposed within said outer coil assembly.

35. The apparatus of claim 34 wherein said other coil is said outer coil.

36. The apparatus of claim 34 wherein said core members are formed of ferrites selected from the group consisting of nickel-zinc ferrite, iron oxide magnetite, nickel ferrite and magnesium ferrite and respectively having a curie temperature point that is at least equal to the maximum anticipated well bore temperatures to which said coil assemblies will be exposed.

37. The apparatus of claim 36 wherein said inner and outer core members are respectively formed of the same ferrite material.

38. The apparatus of claim 34 wherein at least one of said core members is formed of a ferrite composed of about eighteen percent zinc oxide, thirty two percent nickel oxide and fifty percent iron oxide.

39. The apparatus of claim 34 wherein said inner and outer core members are respectively formed of a ferrite composed of about eighteen percent zinc oxide, thirty two percent nickel oxide and fifty percent iron oxide.

40. Apparatus adapted for electromagnetically coupling electrical conductors in a well bore suspension cable to well bore apparatus having at least one electrical device and comprising:

inner and outer coil assemblies respectively including, inner and outer core members formed substantially of ferrite materials having a DC bulk resistivity greater than ten thousands ohm-meters and cooperatively arranged so that said inner core assembly can be telescopically disposed within said outer coil assembly, said core members being formed of ferrites selected from the group consisting of nickel-zinc ferrite, iron oxide magnetite, nickel ferrite and magnesium ferrite and respectively having a curie temperature point that is at least equal to the maximum anticipated well bore temperatures to which said coil assemblies will be exposed, said ferrites further including an additive to the ferrite material of nore more than about ten percent by weight of zirconia in a crystalline or uncrystalline form, and inner and outer coils, disposed within said inner and outer core members, respectively wound around said inner core member and inductively coupling the conductors in a suspension cable connected to one of said coils to a well bore electrical device connected to the other of said coils whenever said inner coil assembly is disposed within said outer coil assembly.

41. The apparatus of claim 40 wherein said other coil is said outer coil.

42. The apparatus of claim 40 wherein said inner and outer core members are respectively formed of the same ferrite material.

43. The apparatus of claim 40 wherein at least one of said core members is formed of a ferrite composed of about eighteen percent zinc oxide, thirty two percent nickel oxide and fifty percent iron oxide.

44. The apparatus of claim 40 wherein said inner and outer core members are respectively formed of a ferrite composed of about eighteen percent zinc oxide, thirty two percent nickel oxide and fifty percent iron oxide.

* * * * *